US005180612A

United States Patent [19]

Rendell

[11] Patent Number: 5,180,612

[45] Date of Patent: Jan. 19, 1993

[54] APPARATUS AND METHOD FOR PROGRESSIVELY COATING A CYLINDER

[75] Inventor: Michael P. Rendell, Dorking, England

[73] Assignee: Komori Currency Technology UK Ltd., Dorking, England

[21] Appl. No.: 706,224

[22] Filed: May 28, 1991

[30] Foreign Application Priority Data

May 31, 1990 [GB] United Kingdom ..... 9012138

[51] Int. Cl.[5] ..... B05D 1/28; B05C 1/08

[52] U.S. Cl. ..... 427/372.2; 427/55; 427/385.5; 427/393.5; 427/428; 118/58; 118/60; 118/232; 118/258; 118/261

[58] Field of Search ..... 427/428, 55, 385.5, 427/393.5, 372.2; 118/232, 233, 258, 261, 60, 58

[56] References Cited

U.S. PATENT DOCUMENTS

| | | | |
|---|---|---|---|
| 2,617,468 | 11/1952 | Holcomb | 154/1.75 |
| 2,830,555 | 4/1958 | Barrett | 118/7 |
| 3,224,897 | 12/1965 | Smith | 117/64 |
| 3,265,034 | 8/1966 | DiMino | 118/68 |
| 3,785,286 | 1/1974 | Giori | 101/155 |
| 3,900,595 | 8/1975 | Giori | 427/55 |
| 4,054,685 | 10/1977 | Giori | 427/55 |
| 4,263,869 | 4/1981 | Wahnschaff | 118/249 |
| 4,397,258 | 8/1983 | Dremel | 118/50 |
| 4,485,132 | 11/1984 | Furuzono et al. | 427/428 |
| 4,844,002 | 7/1989 | Yasui et al. | 118/259 |
| 4,906,335 | 3/1990 | Goodnow et al. | 162/281 |
| 5,015,500 | 5/1991 | Garde | 427/211 |

*Primary Examiner*—Shrive Beck
*Assistant Examiner*—Katherine A. Bareford
*Attorney, Agent, or Firm*—Dilworth & Barrese

[57] ABSTRACT

A coating apparatus is provided with a front roller and a rear roller which rotate in the same rotational sense and opposite to direction of rotation of a parallel cylinder to be coated with fluid material which hardens to a resilient coating thereon. A reservoir of fluid material is provided above a nip between the front and rear rollers, so that the front roller carries a layer of fluid material on a surface thereof to a nip formed between the front roller and the cylinder to be coated, thereby continuously building up thickness of the coating upon the cylinder. Heating elements and temperature sensors in a hood around the cylinder maintain an optimum coating temperature.

6 Claims, 3 Drawing Sheets

APPARATUS AND METHOD FOR PROGRESSIVELY COATING A CYLINDER

BACKGROUND OF THE INVENTION

1. Field of the Invention

This invention relates to a method of and apparatus for coating a cylinder (particularly but not exclusively the wiping cylinder of an intaglio printing machine) with a fluid material (e.g. a heat-hardening plastics material) which hardens to a resilient coating.

2. Background Art

In an intaglio printing machine the wiping cylinders wipe and clean the engraved printing plate or cylinder. The wiping action simultaneously presses the printing ink into the etched detail of the engraving and cleans excess ink from the unengraved areas. In the remainder of each revolution of the wiping cylinder, its surface is washed so that it is completely clean before its next contact with the printing plate. For efficient wiping, therefore, the surface of the wiping cylinder has to be physically and chemically resilient enough to withstand continuous cleaning, and also the friction suffered during pressure against printing plates, and the attrition caused by abrasive pigments in printing inks.

It has been proposed to make such a wiping cylinder with a layer of a synthetic resin plastics composition (U.S. Pat. No. 4,054,685) by rotating the cylinder downwardly past a straight-edged scraper blade which extends parallel to the cylinder axis. The plastics material is supplied to the blade so that a thin layer is spread onto the cylinder. After the layer has been applied to the cylinder, it is heated and then allowed to cool, whereupon another layer can be applied to the underlying hardened layer.

Such an application method has a number of disadvantages.

First, it is a batch process involving separate layer application steps and layer heating steps. The effect of this separation is to lengthen substantially the time necessary for completion of the full coating process.

Second, the heating and coating steps are performed sequentially. Thus, the cylinder is cooling during coating, rather than staying at the optimum coating temperature.

Third, the final coating structure is a laminated one which can suffer from poor inter-layer adhesion, particularly when subject to the shear and torsional stresses of the wiping action to which the cylinder is subject in use.

Fourth, post-application heating of the full thickness of each applied layer can result in excess heating of the surface of the layer, in order to heat through the bulk of the layer. This can give rise to heterogeneity within the layer.

SUMMARY OF THE INVENTION

The present invention aims to overcome or at least ameliorate these disadvantages.

According to a first aspect of the invention there is provided a method of coating a cylinder with a fluid material which hardens to a resilient coating, the method comprising the step of delivering the fluid material to the cylinder on a roller, the cylinder and roller contra-rotating on parallel horizontal axes, the directions of rotation about these axes being such that the respective cylindrical surfaces of the cylinder and roller advance downwardly through the nip between the roller and the cylinder.

Preferably the roller is provided as the front roller of a roller pair, with the rollers of the pair rotating in the same directional sense. A reservoir of the fluid material is contained in the nip between the front and rear rollers of the pair, and fluid material which emerges from below the nip between the front roller and the cylinder to be coated, and which is not adhering to the surface of the cylinder to be coated, is carried back to the reservoir by advancing around the underside of the front roller, transferring to the rear roller at the nip between the two, and then advancing around the underside and far side of the rear roller until eventually returning to the reservoir at the nip between the two rollers.

Control over the coating process can be achieved in a number of ways. First, the temperature of the cylinder to be coated, and the fluid material coating it, affects the viscosity of the fluid material. Second, the pressure at which the roller is pressed against the cylinder to be coated is likely to affect the rate at which a coating layer is built up on the cylinder. Third, the thickness of the layer of fluid material carried on the surface of the roller out of the reservoir and around into the nip with the cylinder to be coated can be controlled by the use of some sort of barrier, e.g. a blade, across the length of the roller.

According to a second aspect of the present invention there is provided apparatus for coating a cylinder with a fluid material which hardens to a resilient coating, the apparatus comprising:

a) a front roller for delivering a layer of said fluid material on its peripheral surface to the surface of the cylinder to be coated;

b) means for carrying the cylinder to be coated horizontally, and for rotating the cylinder about a cylinder axis;

c) a carriage for carrying the front roller horizontal, for rotation about a front roller axis;

d) means for translating the carriage towards and away from the cylinder to be coated, in order to establish a desired spacing (which may be zero) between the front roller and the surface of the cylinder to be coated;

e) a rear roller mounted on the carriage parallel to the front roller and adjacent thereto;

f) means to rotate the front and rear rollers in the same rotational sense as each other, and contrary to the sense of rotation of the cylinder, that is, for advancement of both the front roller surface, and the surface of the cylinder to be coated, downwardly into the nip between the front roller and the cylinder;

g) means for restraining the fluid material from flowing outwardly from the ends of the space between the front and rear rollers above the nip thereof;

h) means for controlling flow of fluid material outwardly from the ends of the space between the front roller and the cylinder to be coated, above the nip thereof;

i) means for heating the coated surface of the cylinder to harden the fluid material coated on the cylinder, during the coating process.

Preferably both rollers have a variable speed drive means so that the surface speed of the front roller can be adjusted relative to the surface speed of the cylinder to be coated.

Preferably an elongate barrier (for example, a blade) is mounted above the front roller for controlling the thickness of the layer of fluid material advanced on the surface of the front roller from its nip with the rear roller to its nip with the cylinder to be coated.

Preferably means are provided to control the surface temperature of the front roller. One convenient way of doing this is to provide for a flow of heating/cooling fluid along the axis of the front roller, internally of the roller.

For a better understanding of the invention and to show how the same may be carried into effect, reference will now be made, by way of example, to the accompanying drawings.

DESCRIPTION OF PREFERRED EMBODIMENTS

Figure 1:
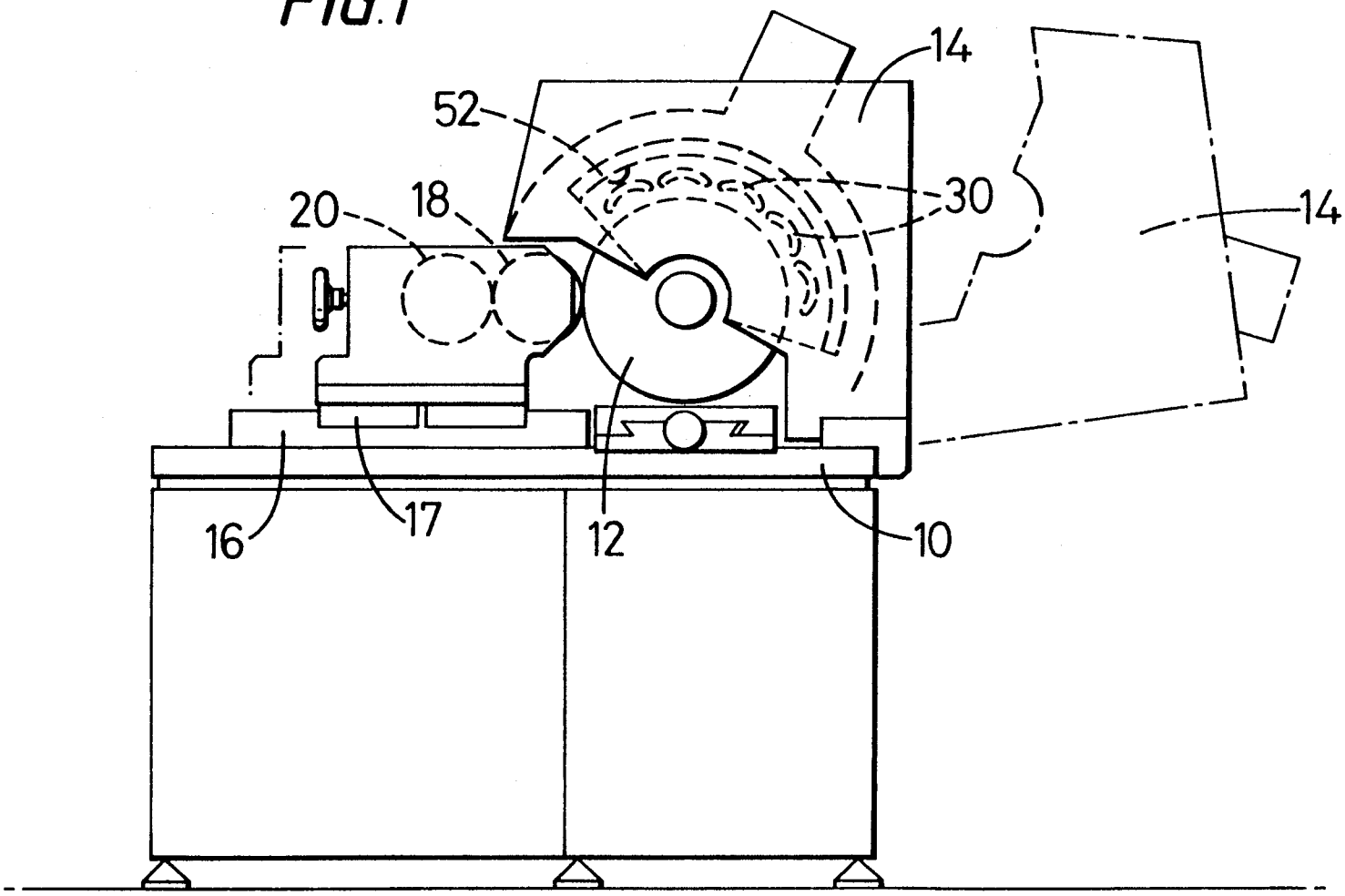
FIG. 1 is a side elevation of an embodiment of cylinder coating apparatus in accordance with the invention.

The cylinder coating apparatus shown in the drawings comprises a base frame 10 on which are carried the cylinder 12 to be coated, a hood 14 which encloses the cylinder and is pivotally movable between a heating disposition (shown full line) and a non-heating disposition (shown chain—dotted), and a track 16 supporting a carriage 17 movable in a controlled manner towards and away from cylinder 12 through double-acting, fluid-powered actuators (not shown).

Figure 2:
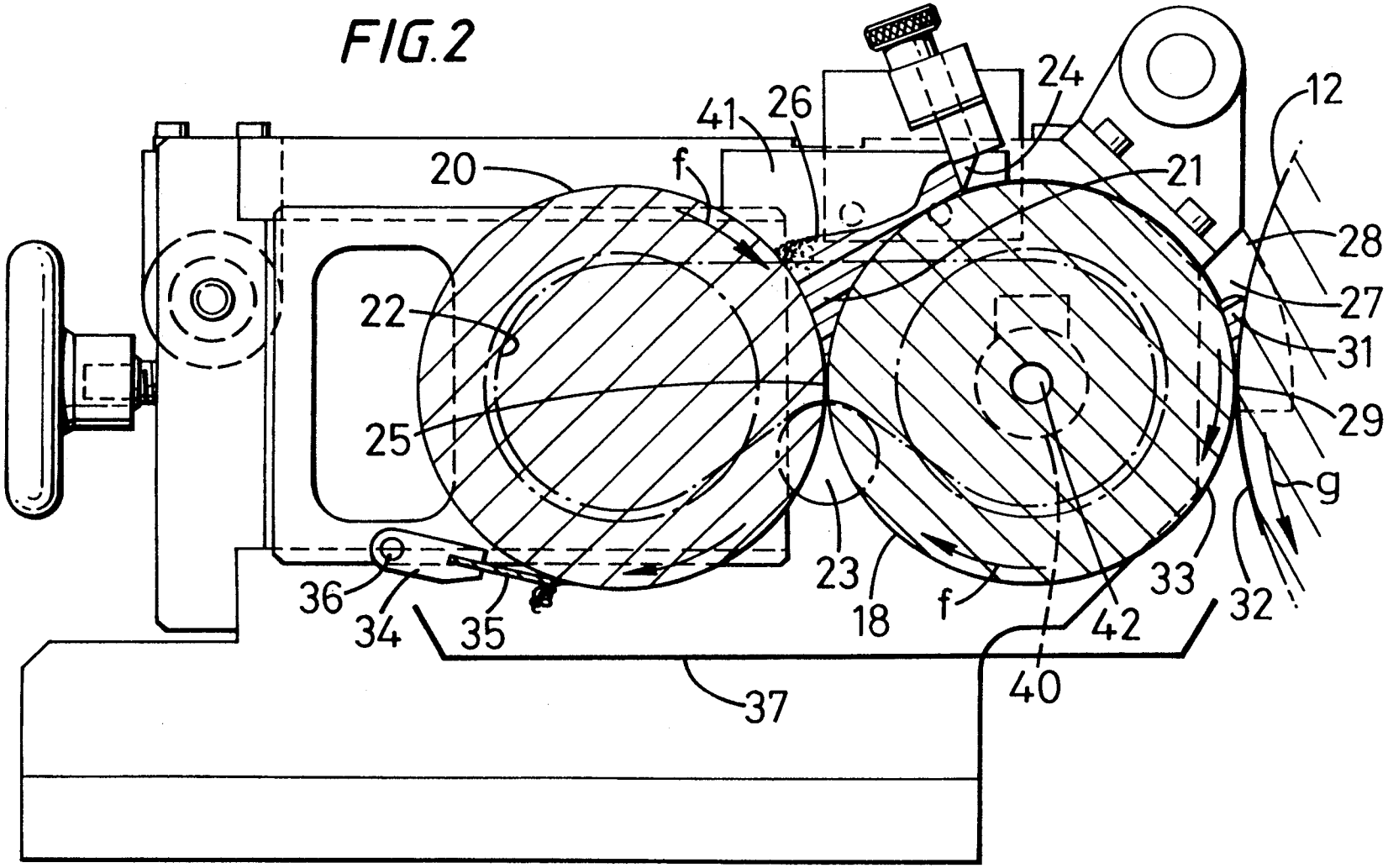
FIG. 2 is an longitudinal section through the front and rear rollers of the apparatus.
Figure 3:
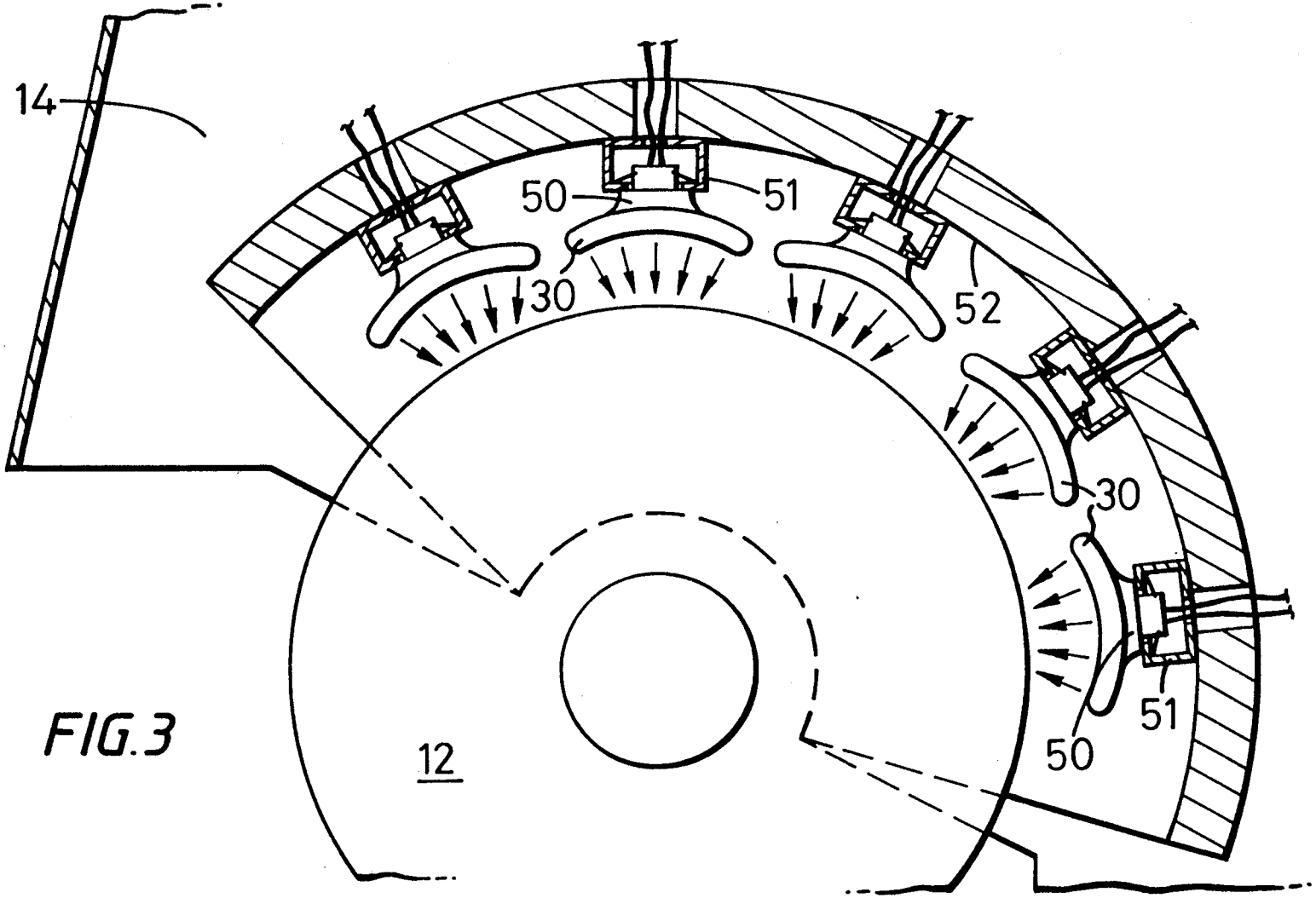
FIG. 3 is a longitudinal section through the hood of the apparatus.

A front roller 18 and a rear roller 20 are rotatably mounted parallel to each other upon the carriage 17. The front roller 18 is driven by an electric motor and speed-matching clutch (40) and is connected (FIG. 2) by a drive belt 22 to the rear roller 20, an idler roller 23 maintaining belt tension, such that both rollers rotate in the same direction f.

An elongate blade barrier 24 is mounted above the front roller 18, in mountings which permit adjustment of its position relative to the roller towards and away from the roller surface. This blade controls the thickness of the layer of plastics material 26 which in use is carried on the surface of the roller 18 from the space 21 above the nip 25 between the front and rear rollers around to the space 27 above the nip 29 between the front roller 18 and the cylinder 12.

A cheek piece 28 of PTFE or other suitable material is mounted at each end of the roller 18 in order to control the flow of fluid material outwardly from the ends of the space 27. This control may fall short of total prevention of any outward flow beyond the nip, for it may be useful to arrange for some of the fluid material to run a short distance around the ends of the cylinder 12 to be coated, in order to strengthen the coating on the cylinder at the ends of the cylinder. Similar cheek pieces (41) are used to confine the fluid material 26 in the space 21 above the nip 25 between the front and rear rollers 18 and 20.

Not shown in the drawings for reasons of clarity are the necessary means for safely extracting toxic exhaust fumes (produced during the process of hardening the fluid material coating the cylinder) from the hood 14, and the electrical control means for operating the various drives and actuators of the apparatus. Such control means is conveniently micro-processor based.

The apparatus is intended to cope with various shapes and sizes of cylinder to be coated. Thus, the bearings in which the cylinder is mounted on the frame 10 resemble the head-stock and tail-stock of a lathe, both of these being transversely movable to accommodate different lengths of cylinder. Particularly short cylinders can be mounted on additional shaft extensions, in order to extend their length. It may be that the cylinder to be coated is not perfectly cylindrical but instead is very slightly cone-shaped. To accommodate such a situation, the carriage 17 is split transversely in two halves, which can be moved relative to each other towards and away from the cylinder to be coated, so that the nip 29 may still be of uniform thickness, even with a cone-shaped cylinder to be coated.

The temperature profile along the length of the cylinder to be coated may need to be under stringent control. The cavity of the hood 14 is therefore fitted with a plurality of heating elements. In the illustrated embodiment these elements 30 are ceramic tile electric heating elements, arranged in a matrix of 5 rows of 8 elements, each row extending the full length of the cylinder 12 under the hood 14. Not shown is an alternative embodiment, also preferred, which has 6 rows of 8 elements.

The dimensions of the tile elements are 123 mm×60 mm. Each tile is curved across its smaller dimension to present a concave downward surface to the roller 12. The tiles are mounted at their rear by clips 50 onto stainless steel channels 51 which in turn are attached to the inside curvature of an internally heat-insulated stainless steel reflector 52. The entire assembly is mounted inside the fume extraction hood 14.

Electrical power to each tile is independently switched by a matrix panel of push buttons (not shown) equipped with internal illumination capability such that those tiles which are switched into circuit at any instant are indicated by the illumination of the corresponding push button. The heating profile is thus displayed by the matrix push button panel.

The amount of electrical power fed to the tile elements is controlled in dependence upon the outputs of three non-contact IR temperature sensors which monitor the temperature of the surface of the cylinder being coated.

More particularly, left and right hand outer sensors monitor all three, two or the outermost one of the outer circumferential columns of tile elements at the left and right hand ends of the matrix, respectively. These columns of the matrix are thus independently controlled or isolated by the outer located sensors. The remaining ones of the 8 columns, in the middle of the matrix, that is, columns 4 and 5 or 3 to 6, or columns 2 to 7, are capable of being electrically controlled by a centrally positioned sensor.

By employing this means of controlling the temperature of the heater tiles, a wide range of cylinder lengths and diameters may be heated to the exact axial temperature profile required for the best polymer coating and hardening conditions.

The tiles operate below red temperature and therefore radiate only within the infra-red wave band. They also radiate a major proportion of their heat output uni-directionally from the front face and are therefore more efficient than other forms of heating elements.

Each ceramic tile is resistant to corrosion from fumes produced by the PVC curing process, and thus produces no corrosion by-products that could fall onto and contaminate the PVC coating on the roller.

In a non-illustrated embodiment, full length radiant heating elements extend longitudinally along the inner surface of the hood 14 whilst shorter radiant heating elements (not shown) are sited at the ends only. The temperature profile of the cylinder to be coated is determined using infrared temperature sensors (not shown) mounted within the hood for continuously monitoring the temperature of the surface of the cylinder. The micro processor control compares data from the infrared sensors with a desired temperature profile and actuates the heaters as appropriate in order to achieve the desired profile.

The front roller 18 is also provided with temperature control means, namely apparatus for flowing through a cavity (42) running the length of the roller a flow of liquid at a temperature appropriate to achieve the desired temperature on the surface of the roller.

In use of the device, the cylinder 12 to be coated is mounted horizontally on the bearing assemblies and the hood 14 is pivoted from its non-heating disposition into its heating disposition over the top of the cylinder. A link between the hood movement and the drive to the cylinder ensures that the hood moves away from its heating disposition when the cylinder drive stops (the hood is made to hinge back if for any reason the cylinder ceases to rotate), so as to ensure that no part of the circumference of the cylinder receives an excessive heat flux. The heaters inside the hood are then switched on and bring the temperature of the surface of the cylinder up to the level suitable to receive the coating material. Meanwhile, liquid flows through the front roller 18 so that its temperature also is brought up to and maintained at its operational temperature.

The peripheral speed of the front roller 18 is selected relative to that of the cylinder 12, to match the peripheral speeds of the roller and cylinder. The speed is selected as follows:

i) Rotate cylinder 12 at coating speed.

ii) Rotate roller 18 at minimum speed.

iii) Advance roller 18 into contact with cylinder 12, whereupon the undirectional drive clutch 40 permits roller 18 to be driven by the cylinder 12, free-wheel, at the same surface speed as cylinder 12.

iv) Adjust roller 18 drive motor speed control until clutch 40 graduations show a surface speed match between this drive and that of cylinder 12.

v) With the surface speeds now matched, the carriage 17 is retracted and the reservoir may be filled with polymer paste.

With the front roller 18 at the desired temperature and rotating, the coating material (for wiping cylinders this would normally be PVC paste) is introduced into the space 21 above the nip 25, with the barrier 24 in close proximity with the surface of the front roller 18 so as to limit to a minimum the amount of plastics material carried out of the reservoir and around the circumference of the front roller 18.

Next, the carriage 17 is moved so as to bring the front roller 18 up against the surface of the cylinder 12. The air pressure within the carriage actuators determines the force with which the front roller 18 is biased into contact with the cylinder 12.

At this stage, the blade 24 can be drawn back from the surface of the roller 18, to allow a significant flow of the PVC material from the reservoir 21 to the nip 29, causing a bead of PVC material to form above the nip 29. Unless the biasing pressure of the roller 18 onto the cylinder 12 is excessive, the contra rotation of the two surfaces downwardly through the nip (arrows f and g) will carry a layer of the fluid material down through the nip, resulting in separate coatings 32 and 33 on the cylinder 12 and roller 18 respectively, below the nip 29. The coating 32 on the cylinder 12 is carried round the periphery of the roller 12 into the region where it is subject to the heating effect of the heaters 30 so that, by the time it arrives again at the space 27 above the nip 29, it has already hardened sufficiently to receive a further coating of the fluid material on top.

Continuous hardening is achieved during the coating build-up, greatly reducing the heating intensity at the completion of the coating phase and minimizing the possibility of outer surface over-heating.

Conversely, the coating 33 on the surface of the roller 18 receives no external heat flux but instead remains unhardened as it advances around the underside of the roller 18 to its nip 25 with the rear roller 20. At this nip, it transfers across to the surface of the rear roller 20 and advances around virtually the entire circumference of the rear roller 20 until it enters again the reservoir of fluid material in the space 21 above the nip.

As the thickness of the coating of successive revolutions 32 on the cylinder 12 increases, the roller 18 is pushed back against the biasing of the compressed air in the piston/cylinder actuators of the carriage 17.

As the coating on the cylinder 12 approaches the desired thickness, the supply of fluid material 26, to the reservoir in the space 21, is stopped. Consequently, delivery of fluid material to the bead 31 in the space 27 is also terminated, and further application of the material to the cylinder 12 continues only until exhaustion of the bead 31.

At this point, reverse actuation of the actuators for the carriage 17 (which are double-acting) draws back the front roller 18 from the cylinder 12.

Normally, the coating on the cylinder 12 is of a material (for example PVC) which hardens on heating. If the coating has to be cured this can be accomplished by continuing to operate the heaters within the hood 14, with the cylinder 12 rotating in the space below the heaters, the setting of the heating elements, and the intensity of the heating effect, being selected in accordance with the requirements of the coating material. As soon as all the necessary physical and chemical changes in the coating material are complete, the heaters 30 can be switched off and after water cooling of the coated cylinder, if desired, the hood 14 moved into its non-heating disposition and the coated cylinder removed. The movement of the hood should await attainment by the coated cylinder of a temperature low enough (say, less than 60° C.) to avoid release to the atmosphere of toxic fumes from the coating on the cylinder.

In the illustrated embodiment the barrier 24 is a blade but a roller could be used instead.

After normal use of the rollers, 18, 20 to clean them of plastics material, a scraper assembly 34 incorporating a scraper blade 35 may be pinned to the carriage 17 by a pair of pins 36 to bring the blade 35 into contact with the rear roller 20. After cleaning, the scraper assembly is again removed from the carriage 17. A tray 37 sits beneath the rollers, for gathering any paste, wash up liquid or other detritus.

INDUSTRIAL APPLICATION

While the illustrated embodiment is intended for coating the wiping cylinders of intaglio printing machines, it is contemplated that the inking cylinders of such printing machines could also be made in the same way. These inking cylinders would be coated with a softer formulation of PVC which would then be engraved with a relief pattern. The method and apparatus of the present invention may find wider application, such as in the coating of cylinders with plastics material which thereafter receives a relief printing image and is used for the manufacture of printed webs of wall covering materials. Currently, these cylinders are of polyurethane material, which is difficult to work with because of the extreme toxicity of the fumes which it generates during curing but the present invention may open up possibilities for coatings which meet operational specifications without the need to resort to the difficult material, polyurethane.

I claim:

1. A method of progressively coating a cylinder to increase its diameter, with layers of a fluid material which hardens to a resilient coating, comprising the steps of:

a) providing a reservoir of the fluid material continuously defined by a nip between front and rear rollers;

b) rotating said front and rear rollers in the same rotational sense whereby the fluid material is caused to flow over said front roller to a surface of the cylinder;

c) horizontally moving said front and rear rollers translationally so that said front roller is maintained at a desired spacing from an existing surface of the cylinder, whereby the fluid material is transferred from said front roller to the cylinder surface;

d) rotating the cylinder in an opposite sense to rotation of said front and rear rollers; and e) heating the cylinder to harden the applied coating as the cylinder rotates, whereby upon each rotation, a new hardened surface for being additionally coated is presented;

whereby fluid material that does not adhere to the cylinder surface is carried back to said reservoir by advancing around an underside of said front roller, being transferred to said rear roller at said nip and then passing around an underside and a far side of said rear roller until reaching said reservoir.

2. Apparatus for progressively coating a cylinder to form a progressively thicker coating thereon of a fluid material which hardens to a resilient coating, comprising:

a) means for carrying horizontally the cylinder to be coated;

b) a front roller for delivering a layer of the fluid material on its peripheral surface to the surface of the cylinder;

c) a rear roller contacting the peripheral surface of said front roller at a nip remote from the cylinder;

d) a reservoir for the fluid material continuously defined above the nip between said front and rear rollers;

e) means for restraining flow of the fluid material sideways from said reservoir;

f) means for rotating said front and rear rollers in the same rotational sense as each other, whereby the fluid material is transferred from said reservoir to sadi front roller and excess fluid material is returned to the reservoir on the surface of said rear roller;

g) means for rotating the cylinder in an opposite rotational sense from said front and rear rollers;

h) means for heating the newly coated surface of the cylinder for hardening the applied coating during a single rotation thereof, whereby upon each successive rotation thereof, a further coating is applied by said front roller to a hardened coating upon the cylinder;

i) a carriage for horizontally carrying said front and rear rollers for rotation; and j) means for horizontally translating said carriage towards and away from the cylinder in order to establish and maintain a desired spacing between said front roller and the existing surface of the cylinder;

whereby fluid material that does not adhere to the cylinder surface is carried back to said reservoir by advancing around an underside of said front roller, being transferred to said rear roller at said nip and then passing around an underside and a far side of said rear roller until reaching said reservoir.

3. An apparatus according to claim 2, including an elongate barrier mounted adjacent said front roller for controlling the thickness of the layer of fluid material being transferred from said reservoir to the cylinder surface.

4. An apparatus according to claim 2, wherein said means for heating comprises a plurality of heating elements, and means to control individually each of said plurality of heating elements.

5. An apparatus according to claim 2, including means to control the surface temperature of said front roller.

6. An apparatus according to claim 5, wherein said temperature control means includes means for directing a heating/cooling fluid along the axis of said roller.

* * * * *